United States Patent [19]

Bonvallet

[11] Patent Number: 4,476,822

[45] Date of Patent: Oct. 16, 1984

[54] HYPOCYCLIC ROLLING CONTACT ROCKER ARM AND PIVOT

[75] Inventor: Duane J. Bonvallet, Ann Arbor, Mich.

[73] Assignee: General Motors Corporation, Detroit, Mich.

[21] Appl. No.: 496,930

[22] Filed: May 23, 1983

[51] Int. Cl.[3] ..... F02L 1/18

[52] U.S. Cl. ..... 123/90.41; 123/90.42

[58] Field of Search ..... 123/90.39, 90.41, 90.42

[56] References Cited

U.S. PATENT DOCUMENTS

| | | | |
|---|---|---|---|
| 1,188,405 | 6/1916 | Brush | 123/90.42 |
| 3,045,658 | 7/1962 | Sampietro | 123/90.42 |
| 4,337,738 | 7/1982 | Bubniak et al. | 123/90.41 X |
| 4,393,820 | 7/1983 | Maki et al. | 123/90.41 |

*Primary Examiner*—Sheldon J. Richter
*Assistant Examiner*—Peggy A. Neils
*Attorney, Agent, or Firm*—Arthur N. Krein

[57] ABSTRACT

A valve train for a reciprocating internal combustion engine has a fulcrum means and a rocker arm that define a pair of cooperating outer and inner cylindrical bearing surface contours, respectively, for carrying the reaction forces of rocker arm pivotal movement, the radius of the outer conformation being substantially two times the radius of the inner conformation, with the center of revolution of the outer conformation being located on the operating axis of the valve, the inner conformation of the rocker arm being located such that an extension thereof will intersect the contact point of the rocker arm on the axis of the valve at the free end thereof. Restrainer means are provided to anchor the cooperating cylindrical conformations for substantially rolling action in relation to each other, the restrainer means comprising a retainer pin means extending outward from the inner conformation and slot means in the fulcrum means of a size to receive the retainer means, the recess means defining opposed sloping straight guide wall surfaces extending outward in the direction toward the center of the inner conformation and over which the retainer pin means slides during rocker arm oscillation, the retainer pin means having opposed sides conforming to the arcs of circles, the centers of which lie on the curved plane of the inner conformation arc.

3 Claims, 4 Drawing Figures

HYPOCYCLIC ROLLING CONTACT ROCKER ARM AND PIVOT

FIELD OF THE INVENTION

This invention relates to valve trains for internal combustion engines and, in particular, to a hypocyclic rolling contact rocker arm and pivot assembly for use in such valve trains.

DESCRIPTION OF THE PRIOR ART

Conventional rocker arm and pivot assemblies, as normally used in passenger vehicle type engine valve trains, for example, as used in an overhead valve push-rod type actuated valve train, include a pedestal mounted rocker arm which generally has a spherical or part cylindrical pivot or fulcrum that provide essentially large bearing surfaces. With such an arrangement, the rocker arm is actually in sliding engagement relative to its associate fulcrum and, thus even though these elements may be adequately lubricated, this type arrangement still provides a large area for frictional resistance so as to produce a heat build-up as a result of the loads being applied to the respective bearing surfaces.

The desirability to overcome the above problem has been recognized and, accordingly, various specially constructed or non-production, in terms of passenger vehicle usage, type rocker arm assemblies have been proposed. Such specially constructed or non-production type rocker arm assemblies have been used in special engine applications, as for example, in engines of race cars. Thus in such specialized engine applications, in order to reduce friction, roller bearing assemblies have been used to pivotally support a rocker arm. Such roller bearing assemblies are mounted, for example, on stub shafts secured to a fulcrum in a manner whereby to pivotably support an associate rocker arm in a manner similar to that shown, for example, in U.S. Pat. No. 3,621,823, entitled Frictionless Rocker Arm Fulcrum Assembly, issued Nov. 23, 1971 to John Lombardi.

It is readily apparent that such a rocker arm and its associate pivot assembly which includes one or more roller bearing assemblies is far more complex and expensive, from a production standpoint, to use in conventional passenger vehicle engines.

It has also been proposed to provide a rocker arm and pivot arrangement such that the rocker arm is claimed to be movable about a support in rolling motion in a manner shown, for example, in U.S. Pat. No. 2,943,612 entitled Valve Gear which issued on July 5, 1960 to Alexander G. Middler as an improvement over the rocker arm pivot structure shown in U.S. Pat. No. 1,497,451 entitled Rocker Arm issued June 10, 1924 to John F. Kytlica. However, it will be apparent that the rolling contact between the rocker arm and pivot of this 2,943,612 patent teaching is comparable to that of a cylinder rolling on a flat or substantially flat surface.

As a further improvement there has been disclosed in U.S. patent application Ser. No. 356,926, filed Mar. 10, 1982 in the names of Emil R. Maki; Ferdinand Freudenstein; Raymond L. Richard, Jr., and Meng-Sang Chew, a rolling contact rocker arm and pivot assembly that includes a rocker arm with a semi-cylindrical bearing surface intermediate its ends and an associate fixed pivot member having a semi-cylindrical fulcrum bearing surface, the ratio of the radii of these surfaces being on the order of 3:1 to 1.7:1 and preferably 2:1 to provide for cardanic motion. In this assembly, one of the bearing surfaces is provided with a guide recess or slot therein of a size and shape so as to receive in substantially rolling contact a raised retainer pin provided on the other bearing surface, the slot and retainer being located intermediate the arcuate ends of the respective bearing surface.

SUMMARY OF THE INVENTION

A primary object of the present invention is to provide an improved rocker arm and pivot assembly wherein an otherwise conventional type rocker arm and its fixed fulcrum are provided with part circular convex and concave bearing surfaces respectively having a radius relationship of substantially 2 R and R, respectively, with these elements being provided with a retainer pin and slot arrangement whereby there is effected substantially rolling or walking contact between all parts relative to each other during pivotable movement of the rocker arm and wherein the center of revolution of the convex surface being located on the operating axis of an associate valve and the point of contact of the rocker arm against the stem of the valve being located as an arcuate extension of the concave bearing surface so that straight line motion will be imparted to the valve.

Accordingly, another object of this invention is to provide an improved rocker arm and pivot assembly that is operative so as to impart straight line motion to a valve, the pivot defining a rocking bearing support intermediate the length of the rocker arm, the pivot and the rocker arm defining a pair of cooperative outer and inner semi-cylindrical bearing surface contours carrying the reaction forces of the rocker arm pivotal movement, the radius of the outer conformation being substantially two times the radius of the inner conformation with the center of revolution of the outer conformation being located on the operating axis of the valve, the inner conformation of the rocker arm being located such that an extension thereof will intersect the contact point of the rocker arm on the axis of the valve at the stem end thereof. The pivot is provided with a slot means of a size and shape so as to receive in substantially rolling contact a retainer pin means provided on the rocker arm.

Still another object of this invention is to provide an improved rocker arm and pivot assembly for use in the valve trains of internal combustion engines which, in operation, is characterized by minimum energy loss to thus maximize fuel efficiency.

A still further object of the present invention is to provide a rocker arm and pivot of the above type which is easy and inexpensive to manufacture, which is reliable in operation, and in other respects suitable for use on production motor vehicle engines.

For a better understanding of the invention, as well as other objects and further features thereof, reference is had to the following detailed description to be read in connection with the accompanying drawings.

DESCRIPTION OF THE PREFERRED EMBODIMENT

Figure 1:
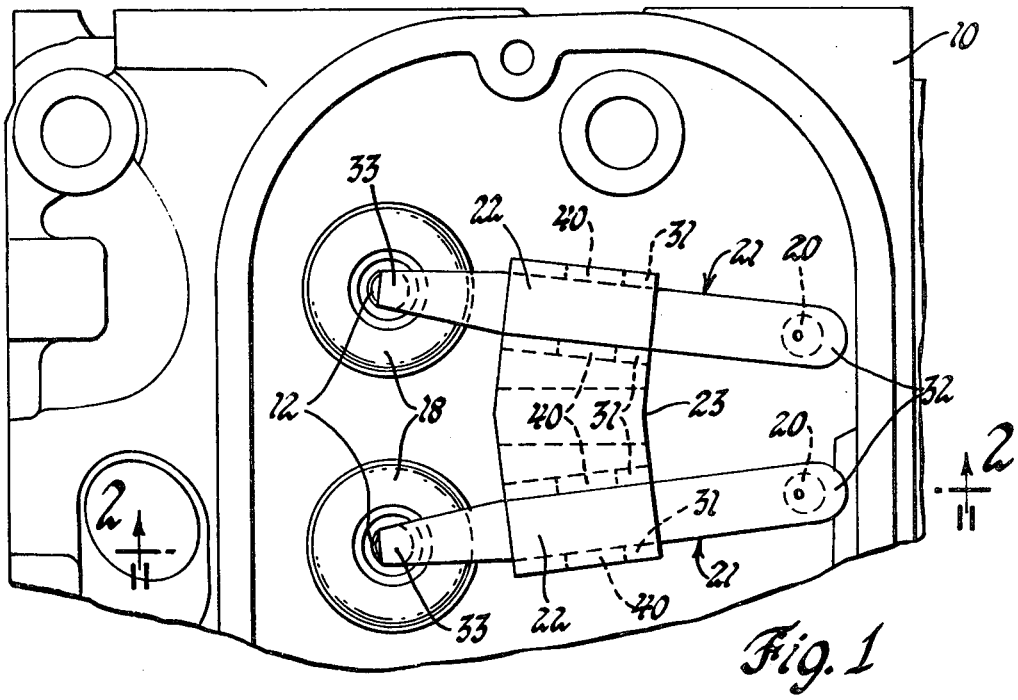
FIG. 1 is a top view of a portion of an internal combustion engine, with the valve cover removed, having valve trains in accordance with the invention incorporated therein.

Referring first to FIG. 1 there is shown a portion of an internal combustion engine, of the conventional overhead valve type, having a cylinder head 10 in which a pair of poppet valves 12 (intake and exhaust) are operatively mounted to control the ingress of a combustion mixture to a cylinder, not shown, of the engine and to control the egress of exhaust gases therefrom. A pair of valve trains, in accordance with the invention, are operatively associated with the valves 12 to effect their operation.

Figure 2:
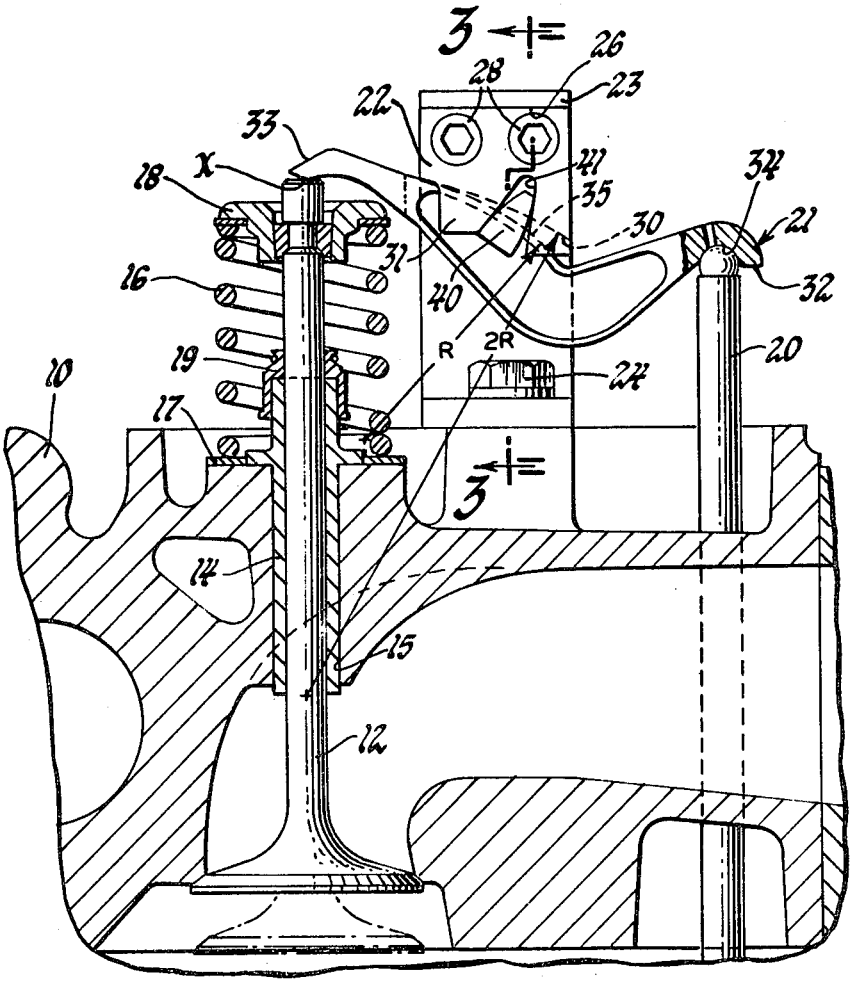
FIG. 2 is a cross-sectional view taken along line 2—2 of FIG. 1 showing a valve train and associate valve, the rocker arm being shown in the valve closed position.

As best seen in FIG. 2, each poppet valve 12 is guided for axial reciprocation in a valve stem guide 14 that is received in a suitable bored opening 15 provided for this purpose in the cylinder head 10, with the upper portion of the poppet valve 12 projecting above the cylinder head. In a conventional manner, the poppet valve 12 is normally maintained in a closed position by a spring 16 encircling the upper portion of the stem of the valve 12, with one end of the spring 16 engaging a washer 17 on the cylinder head 10 and the other end operatively engaging a conventional retaining washer assembly 18 secured to the stem of the poppet valve 12 in a conventional manner. A conventional valve stem seal 19 is positioned so as to sealingly engage the stem of the poppet valve.

A push rod 20, which is reciprocably disposed in the cylinder head laterally of the poppet valve 12, has its upper end projecting above the cylinder head 10. As would be conventional, the lower end of the push rod 20 abuts against the upper end of a conventional hydraulic valve tappet, not shown, which operatively engages the cam of a camshaft, not shown, in a conventional manner whereby the push rod is caused to reciprocate, as determined by the profile of the cam on the camshaft, not shown.

Motion of the push rod 20 is imparted to the poppet valve 12 by means of a rocker arm 21 that is pivotably supported by means of a fulcrum 22 fixed to a support member 23 which is rigidly mounted, as by screws 24, to the top of the cylinder head 10 at a suitable location between an associate set of push rods 20 and poppet valves 12.

Figure 3:
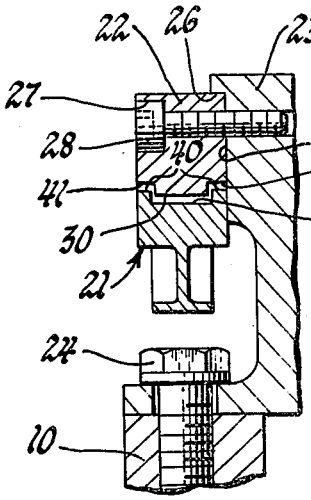
FIG. 3 is a cross-sectional view, taken along line 3—3 of FIG. 2, showing the rocker arm and fulcrum of the valve train assembly; and, FIG. 4 is a pictorial view of the valve train of FIG. 2 showing the geometry of the valve train in accordance with the invention.

In the construction shown and as best seen in FIG. 1, the support member 23 is configured so as to support on opposite sides thereof a right hand and a left hand fulcrum 22, for the poppet valves 12 intake and exhaust, respectively associated with a cylinder, not shown, of the engine. In the construction illustrated and as best seen in FIG. 3, each side of the support member 23 is suitably formed so as to provide a vertical support surface 25 and a shoulder 26 at right angles to each other so as to receive an associate fulcrum 22 in a manner whereby to prevent movement of the fulcrum, the right hand fulcrum being shown in FIGS. 2 and 3. Each fulcrum 22 is suitably secured to the support member 23 as by means of screws 28, each of which extends through a stepped bore 27 in the fulcrum so as to be threadingly received in the support member 23.

Since the fulcrums 22 are of similar construction but of opposite hand it is deemed necessary to describe only the right hand fulcrum.

As shown, the right hand fulcrum 22, of inverted U-shape, is provided with a lower semi-cylindrical concave bearing surface 30 of a suitable predetermined radius 2 R in the central portion thereof and, in the construction illustrated, with retainer arms 31 depending downward from opposite sides of the bearing surface 30, all for a purpose to be described in detail hereinafter. As previously described, the left hand fulcrum 22 is of the same configuration as the right hand fulcrum 22 but of the opposite hand, that is, to accept the screws 28 in a manner to permit it to be mounted on the opposite side of the support member 23 from the right hand fulcrum.

Since the right hand and left hand rocker arms 21 are also of similar configuration, only the right hand rocker arm 21, illustrated in FIGS. 2 and 3, will be described. This rocker arm 21 is provided with arms 32 and 33 overlying and resting on the upper ends of the associate push rod 20 and poppet valve 12, respectively. As shown in FIG. 2, the bottom surface of the arm 32 is spherically dished as at 34 to socketably receive the upper ball end of the push rod 20. Between the arms 32 and 33, the rocker arm 21 is provided with an upper, intermediate, semi-cylindrical convex bearing surface 35 of a radius R. As best seen in FIG. 3, the width of this bearing surface 35 is formed complimentary to the width of the bearing surface 30 for suitable engagement therewith.

Figure 4:
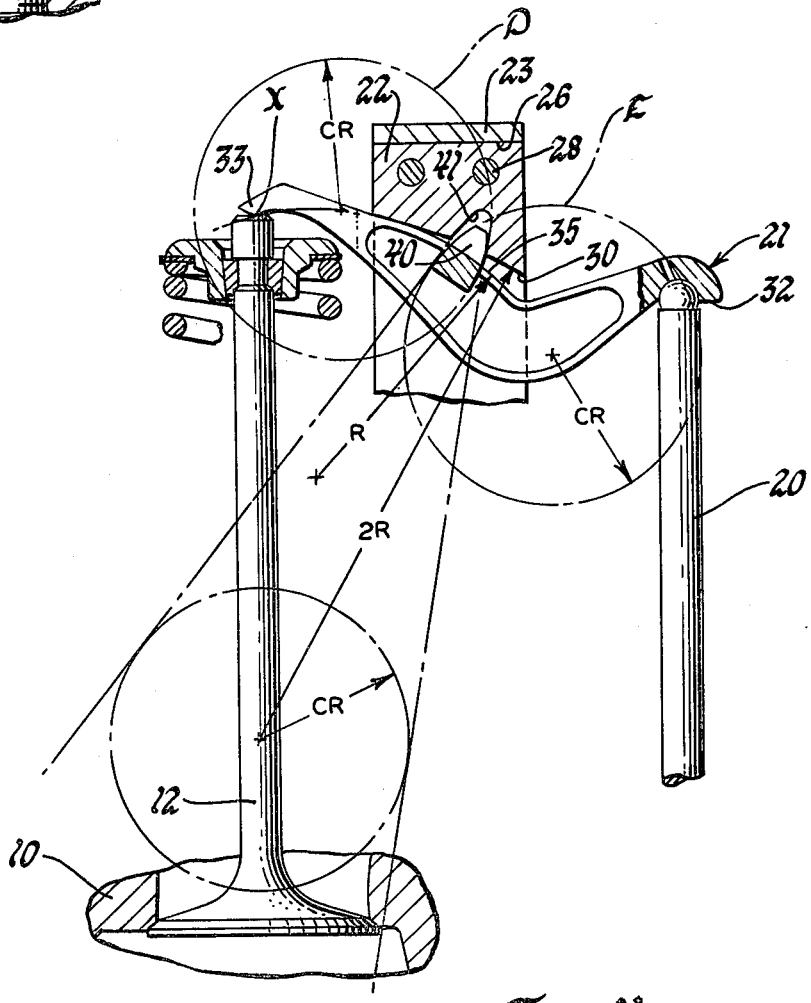

Now in accordance with a feature of the invention, the bearing surface 30 of the fulcrum 22 with a radius 2 R is positioned so that the center of revolution of this bearing surface is located on the operating axis of the associate poppet valve 12, as shown in FIG. 4. In addition, the bearing surface 35 of a radius R is located and the arm 33 is so configured, whereby an extension of the bearing surface 35, as shown in FIGS. 2 and 4, will intersect the contact point X of the lower surface of the arm 33 onto the axis of the associate poppet valve 12 at the upper free end thereof.

With this arrangement, wherein the bearing surface 30, of a radius 2 R defines an outer conformation, the bearing surface 35 defines an inner conformation, during pivotal movement of the rocker arm 21, the bearing surface 35 of the rocker arm 21 will be in rolling contact with the bearing surface 30 of the associate fulcrum 22. The relative rolling contact between these bearing surfaces 30, 35 having a radii ratio of 2:1 is a special case hypocycloid often referred to as cardanic motion. Cardanic motion is the plane motion of a circle or cylinder rolling inside another circle or cylinder, respectively, twice its size without slippage at the contact point between these elements. Thus in the embodiment of the rocker arm and fulcrum shown, the cardanic motion is obtained by having the radii of curvature of these fixed and moving centrodes in the ratio of 2:1, with the centrodes lying on the same side of a common tangent. With this ratio of the radii of 2:1 to obtain cardanic motion, a point on the circumference of the rolling circle or cylinder will be in a straight line extending through the center of the outside circle or cylinder. Thus, the hypocycloid for this special case in which the inner circle or cylinder is one-half the diameter of the outer circle or cylinder is a straight line passing through the center of the outer circle or cylinder.

Accordingly, since the point X on the rocker arm 21 is located, in effect, on the effective circumference of the rolling cylinder, that is, the bearing surface 35 of rocker arm 21, movement of this point X will be in a straight line extending through the center of the outer cylinder, that is the center of revolution defining, the bearing surface 30 of fulcrum 22, which center, as described hereinabove, is located on the reciprocating axis of the associate poppet valve 12. Thus during engine operation, a straight line force is applied by the arm 33 on the associate poppet valve 12, a line which corresponds to the reciprocating axis of this valve. Thus the rocker arm 21 will produce straight line-zero scrub motion at the rocker arm-valve stem contact point X.

In order to insure substantial rolling contact of the rocker arm 21 on its associate fulcrum 22, the rocker arm 21 is provided with raised retainer pins or teeth 40 located on opposite sides of the bearing surfaces 35 thereof which are adapted to operate in tapered guide slots 41 provided in each of the retainer arms 31 of the fulcrum 22.

As best seen in FIG. 4, the centers of the slots 41 lie on a plane that extends from the center of revolution of the bearing surface 30 through the point of line contact of the bearing surface 35 on the bearing surface 30 at the mean position of the rocker arm 21, that is, in its travel from the valve closed position shown in FIGS. 2 and 4 to a full valve open position.

Now in accordance with another feature of the invention, the special straight line hypocycloid is utilized to simplify the shape and to thus reduce the manufacturing cost of the locating pin and slot and this construction is graphically illustrated in FIG. 4. By way of example, the configuration of each retainer pin and its associate slot will be described herein using the dimension of a rocker arm and pivot structure used in a particular internal combustion engine application.

Thus in this particular rocker arm and pivot application, the radius 2 R of the bearing surface 30 on the fulcrum 22 was 88.9 millimeters and, accordingly the radius R of the bearing surface 35 on the associate rocker arm 21 was 44.45 millimeters.

Referring now to the retainer pin 40 configuration, the opposed sides of the retainer pin are of semi-cylindrical configuration, that is, as shown in FIG. 4, they are segments on circles D and E of a radius CR of 25 millimeters, with the centers thereof located on the curved plane conforming to an extension of the bearing surface 35 of the rocker arm 21.

Accordingly, then the centers of these circles D and E will travel along straight lines through the center of the outer conformation, that is, through the center of the bearing surface 30.

It therefore follows that the tangents of the circles D and E that parallel the paths of the centers of these circles D and E are always the same straight lines, which thus permits the opposed sides of an associate guide slot 41 to be straight lines.

Thus the opposed surfaces of a guide pin 40 are semicircular and the opposed sides of an associate slot 41 are straight lines as viewed in the construction illustrated in FIGS. 2 and 4, with these sides preferably being interconnected by a curved wall of suitable radius, as desired. As shown in FIG. 4, the opposed straight wall sides of each slot 41 are thus lined in planes that are tangent to a circle of a construction radius CR of 25 millimeters, the center of revolution of this circle corresponding to the center of revolution of the bearing surface 30 that is located on the reciprocating axis of the associate poppet valve 12.

As will be apparent to those skilled in the art, the centers of the circles D and E are located so as to provide a retainer pin of suitable width and thus of a suitable strength for a given application. Thus in the construction described, the centers of the circles D and E were located so as to provide for a width across the retainer pin 40, at the bearing surface 35 location of this pin, of approximately 5.60 mm. It will be apparent that the spacing between the set of retainer pins 40 on a rocker arm 21 is selected so as to be greater than the width of the bearing surface 30 of the associate fulcrum 22 so as to permit rolling contact engagement between the bearing surfaces 30 and 35 as shown in FIG. 3.

As should now be apparent, the retainer pins 40 and associate slots 41 will not only insure substantially rolling contact of the rocker arm 21 on its associate fulcrum 22 but will also maintain the correct alignment of these elements.

The advantages of the hypocyclic rolling contact rocker arm and pivot of the subject invention are as follows:

1. The rolling friction between the rocker arm and its stationary fulcrum is less than the sliding friction of conventional rocker shafts or ball pivots.

2. The zero scrub straight line actuation of the subject rocker arm effectively eliminates the scrub losses at the rocker arm-valve stem interface.

3. True straight line actuation of the valve eliminates the kinematic side loads on the valve guide. This has the following advantages:

a. Reduced friction losses in the valve guide.
   b. This in turn permits use of smaller diameter valve stems further reducing valve guide losses, and proportionally lowering valve guide seal losses.
   c. Smaller valve stems lower the valve mass, which permits lower valve return spring force, lowering the losses through the entire valve train.

While this invention has been described with reference to a particular embodiment disclosed herein, it is not confined to the details set forth since it is apparent that various modifications can be made by those skilled in the art without departing from the scope of the invention. For example, in lieu of effecting operation of the rocker arms by means of push rods, they could be operated directly by an overhead camshaft in a known manner. This application is therefore intended to cover such modifications or changes as may come within the purposes of the invention as defined by the following claims.

The embodiments of the invention in which an exclusive property or privilege is claimed are defined as follows:

1. A reciprocating internal combustion engine of the type having an engine block defining a cylinder with a port, a valve located for axial movement in said port and biased to a predetermined position, a valve actuator spaced from the valve and operable to effect reciprocation of the valve, and a valve train means including a rocker arm in engagement with the valve and the valve actuator and actuated in rocking movement to reciprocate said valve against said bias to open and close the port for engine operation, the improvement comprising:

fulcrum means defining a fixed rocking support intermediate the length of the rocker arm, said fulcrum means and said rocker arm defining a pair of cooperating outer and inner cylindrical bearing surface contours respectively, carrying the reaction forces of rocker arm pivotal movement, the radius of the outer conformation being substantially two times the radius of the inner conformation, with the center of revolution of the outer conformation being located on the operating axis of said valve, the inner conformation of said rocker arm being located such that an extension thereof will intersect the contact point of said rocker arm on the axis of said valve at the free end thereof;

restrainer means to anchor the cooperating cylindrical conformations for substantially rolling action in relation to each other, said restrainer means comprising a retainer pin means extending outward from the inner conformation and a slot means in the fulcrum means of a size to receive said pin, said retainer pin means having opposed semi-cylindrical surfaces defined by circles whose centers of revolution are located on the curved plane of said inner conformation and each said slot means having inclined straight wall guide surfaces over which the associated said retainer pin means slides during rocker arm oscillation, whereby within the range of rocker arm oscillation said retainer pin means establishes substantially rolling contact between the cylindrical surfaces by contact with the guide surfaces of the recess.

2. A reciprocating internal combustion engine of the type having an engine block defining a cylinder with a port, a valve located for axial movement in said port and biased to a predetermined position, a valve actuator spaced from the valve and operable to effect reciprocation of the valve, and a valve train means including a rocker arm in engagement with the valve and the valve actuator and actuated in rocking movement to reciprocate said valve against said bias to open and close the port for engine operation, the improvement comprising:

fulcrum means defining a fixed rocking support intermediate the length of the rocker arm, said fulcrum means and said rocker arm defining a pair of cooperating concave and convex cylindrical bearing surfaces respectively, carrying the reaction forces of rocker arm pivotal movement, the radius of the concave bearing surface being substantially two times the radius of the convex bearing surface, with the center of revolution of the concave bearing surface being located on the operating axis of said valve, the convex bearing surface of said rocker arm being located such that an extension thereof will intersect the contact point of said rocker arm on the axis of said valve at the free end thereof;

restrainer means to anchor the cooperating cylindrical conformations for substantially rolling action in relation to each other, said restrainer means comprising a retainer pin means on said rocker arm extending radially outward from the convex bearing surface and a slot means in the fulcrum means of a size to receive said retainer pin means, said recess means defining opposed sloping straight wall guide surfaces outward in the direction toward the center of the concave bearing surface and over which the pin slides during rocker arm oscillation, each said retainer pin means having opposed semi-cylindrical surfaces conforming to imaginary circles the centers of which lie on the plane of said convex bearing surface, whereby within the range of rocker arm oscillation said pin means establishes substantially rolling contact between the cylindrical surfaces by contact with the guide surfaces of the slot means.

3. A reciprocating internal combustion engine of the type having an engine block defining a cylinder with a port, a valve located for axial movement in said port and biased to a predetermined position, a valve actuator spaced from the valve and operable to effect reciprocation of the valve, and a valve train means including a rocker arm in engagement at opposite ends with the valve and the valve actuator and intermediate its ends with a fulcrum means whereby the rocker arm can be actuated in rocking movement to reciprocate said valve against said bias to open and close the port for engine operation, the improvement wherein:

said fulcrum means defines a rocking support intermediate the length of said rocker arm, said fulcrum means and said rocker arm defining a pair of cooperating outer and inner semi-cylindrical bearing surface contours, respectively, carrying the reaction forces of rocker arm pivotal movement, the radius of the outer conformation being substantially two times the radius of the inner conformation, with the center of revolution of the outer conformation located so as to lie on the operating axis of said valve, said rocker arm being of a configuration whereby an extension of said inner conformation intersects the contact point of said rocker arm on the axis of said valve at the free end of said valve;

said rocker arm having pin means thereon extending outward from the inner conformation and said fulcrum means having a recess means therein of a size to receive said pin means, said recess means defining opposed sloping guide surfaces extending outward in the direction toward the center of the inner conformation and over which the pin slides during rocker arm oscillation, whereby within the range of rocker arm oscillation the pin means establishes substantially rolling contact between the cylindrical surfaces by contact with the guide surfaces of said recess means.

* * * * *